United States Patent [19]

Wieninger et al.

[11] Patent Number: 4,903,410

[45] Date of Patent: Feb. 27, 1990

[54] GUIDE BAR FOR A CHAIN SAW

[75] Inventors: Klaus Wieninger, Waiblingen; Walter Sattelmaier, Ludwigsburg; Wilfried Noll, Waiblingen; Hans P. Stehle, Waiblingen; Norbert Apfel, Waiblingen, all of Fed. Rep. of Germany

[73] Assignee: Andreas Stihl, Waiblingen, Fed. Rep. of Germany

[21] Appl. No.: 242,229

[22] Filed: Sep. 9, 1988

[30] Foreign Application Priority Data

Sep. 9, 1987 [DE] Fed. Rep. of Germany ..... 3730171

[51] Int. Cl.[4] ..... B25B 17/02

[52] U.S. Cl. ..... 30/387; 83/821; 29/419.1

[58] Field of Search ..... 30/387, 382, 383, 381; 83/821; 76/112, 25 R, 101 R; 29/419.1

[56] References Cited

U.S. PATENT DOCUMENTS

| | | | |
|---|---|---|---|
| 3,473,581 | 10/1969 | Merz | 30/387 |
| 3,545,505 | 12/1970 | DeWesse | 83/821 |
| 3,864,807 | 2/1975 | Schneider et al. | 29/419.1 |
| 3,890,690 | 6/1975 | Li | 29/419.1 |
| 4,693,007 | 9/1987 | Apfel et al. | 30/387 |

FOREIGN PATENT DOCUMENTS

| | | | |
|---|---|---|---|
| 657445 | 2/1963 | Canada | 30/387 |

*Primary Examiner*—Douglas D. Watts
*Assistant Examiner*—Y. Lin
*Attorney, Agent, or Firm*—Walter Ottesen

[57] ABSTRACT

A guide bar for a motor-driven chain saw is disclosed wherein the guide bar is provided with a center cutout extending in the longitudinal direction of the bar which is filled out with a bonded fiber material made of plastic and reinforced with long fibers. The guide bar reduces the weight and facilitates manipulation of the chain saw equipped therewith while at the same time providing a high strength and the capacity to take up bending and torsion loads.

34 Claims, 4 Drawing Sheets

Fig. 2
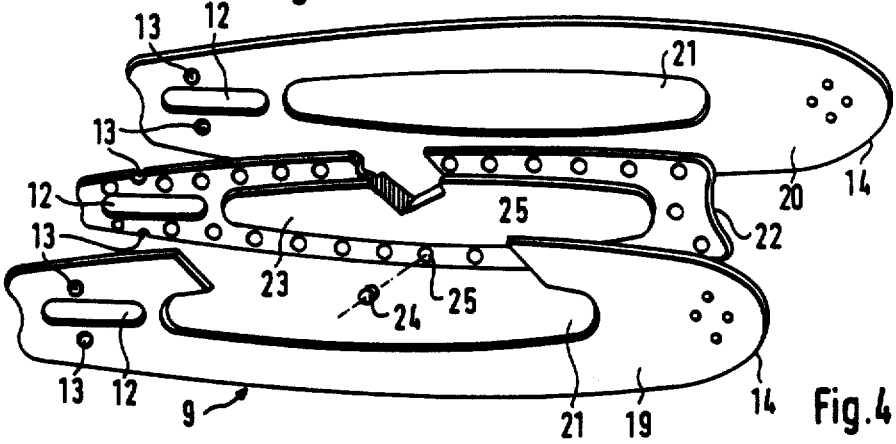
Fig. 4
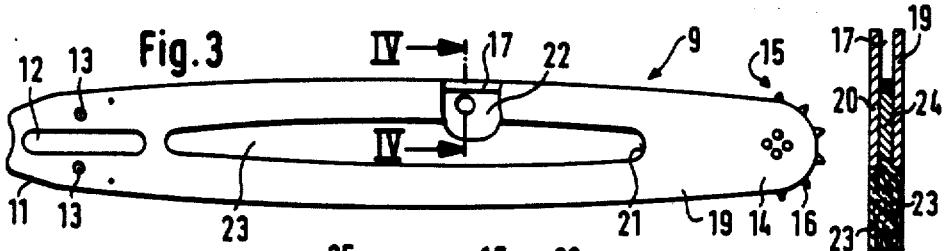
Fig. 3
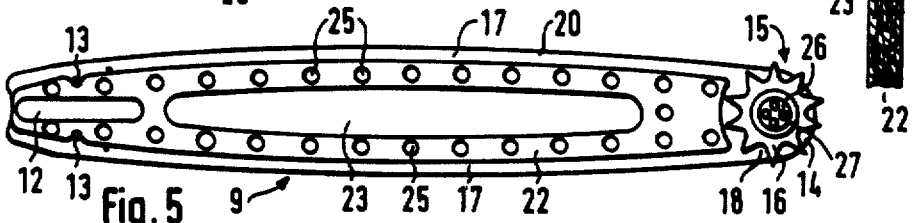
Fig. 5
Fig. 7a
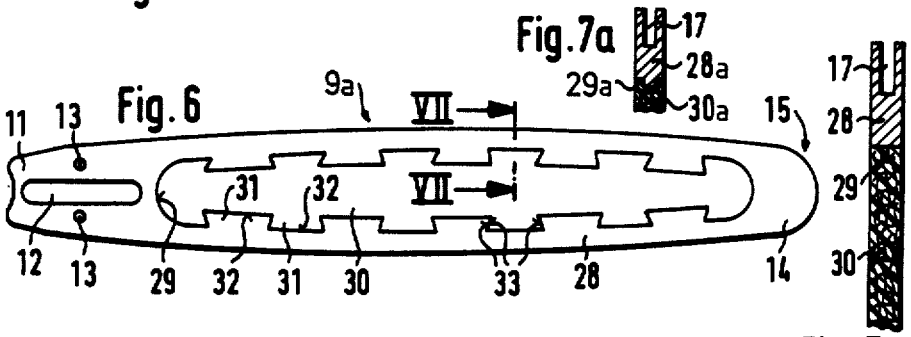
Fig. 6
Fig. 7

GUIDE BAR FOR A CHAIN SAW

FIELD OF THE INVENTION

The invention relates to a guide bar for a motor-driven chain saw with at least one steel plate for guiding the saw chain. The steel plate has at least one cutout formed therein lying in the plane of the guide bar which is filled with a plastic insert.

BACKGROUND OF THE INVENTION

A guide bar of the kind described above is provided to guide and support an endless saw chain running around the periphery thereof. The guide bar is releasably attached at one end to the motor-driven chain saw and projects outwardly therefrom for its entire length in the manner of a cantilever. Because of its attachment at one end, the guide bar must take up loading which occurs at its free end such as the high forces occurring in the case of plunge-cutting operations, for example. During such operations, large bending and/or torsion forces can be directed into the guide bar, for example, when the latter jams in the kerf. These loadings are more intense in their effect the longer that the guide bar is. The guide bar must therefore have a high strength which can be obtained by a correspondingly heavy configuration. A heavy guide bar is, however, very disadvantageous in the case of handheld portable motor-driven chain saws because this inevitably makes manipulation of the chain saw more difficult. For this reason, attempts have long been made to reduce the weight of the guide bar.

U.S. Pat. No. 3,545,505 discloses an arrangement for saving weight wherein the guide bar is made up of a plurality of parts such that it has two outer plates made of high-quality steel which are intended to take up the mechanical loading. A center layer made of plastic is provided between both outer steel plates to save weight. Furthermore, it is known in a multi-layered guide bar as shown in U.S. Pat. No. 3,545,505 and in a full guide bar as shown in German Patent No. 728,639 to provide the steel plates with cutouts lying in the plane of the guide bar and to fill these cutouts with a specific lighter material such as plastic or light-weight metal. However, with reference to the practical application, no satisfactory self-rigidity could be obtained and especially a guide bar instability which is too great could be observed especially with professional continuous use which caused guide bars of this kind not to be very successful in the market place.

SUMMARY OF THE INVENTION

It is an object of the invention to provide a guide bar which has at least one cutout disposed in the plane of the bar which is filled with a plastic insert and which is so improved that it provides an especially high strength against bending loads, pressure loads, wear and torsion loads while at the same time having a very low weight.

According to a feature of the invention, the insert in the cutout of the steel plate comprises a bonded fiber material made of plastic and reinforced with long fibers. The fibers of the material extend substantially or completely over the length of the insert.

As a consequence of this configuration, the insert has not only a distance holding function but it forms a supporting part of the guide bar which contributes a large portion (for example 40%) of the bending strength of the guide bar.

BRIEF DESCRIPTION OF THE DRAWINGS

The invention will now be described with reference to the drawings wherein:

FIG. 2 is an exploded perspective view of the guide bar shown in FIG. 1;

FIG. 3 is a elevation view of the guide bar shown in FIGS. 1 and 2 with a portion of a steel side plate broken away to expose the spacer;

FIG. 4 is an enlarged section view taken along line IV—IV of the guide bar shown in FIG. 3;

FIG. 5 is a side elevation view of the guide bar of FIG. 3 shown one of the steel side plates removed;

FIG. 6 is a side elevation view of a guide bar according to another embodiment of the invention wherein a single steel plate configured as a full bar is provided for guiding the saw chain;

FIG. 7 is an enlarged section view of a portion of the guide bar of FIG. 6 taken along line VII—VII and FIG. *7a* is a view corresponding to that of FIG. 7 and shows an alternate configuration;

DESCRIPTION OF THE PREFERRED EMBODIMENTS OF THE INVENTION

Figure 1:
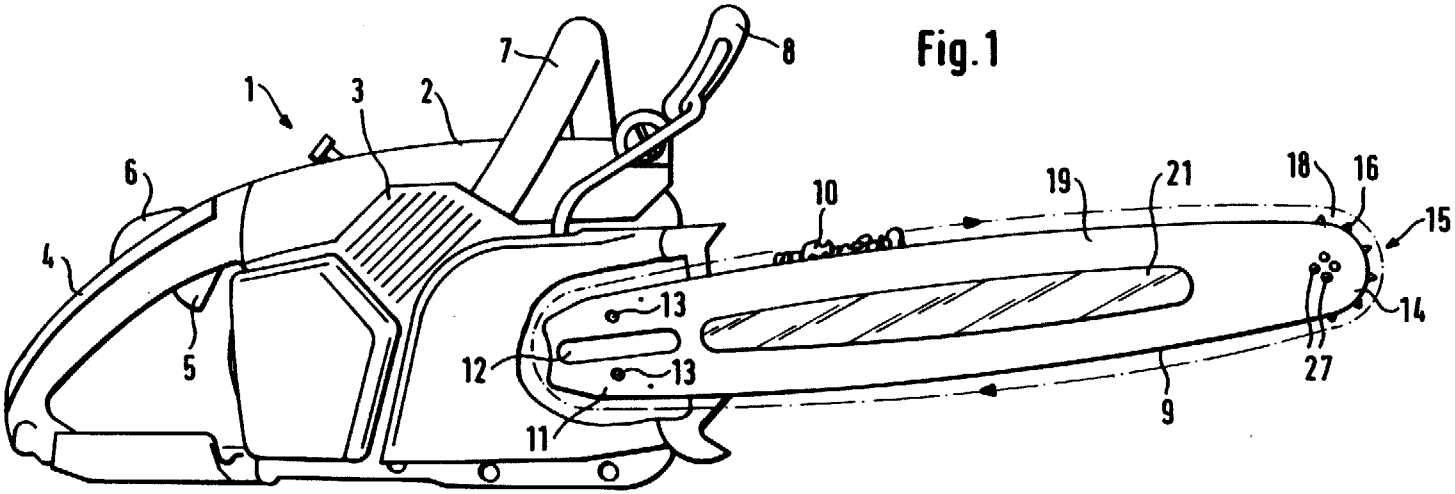
FIG. 1 is a side elevation view of a motor-driven chain saw equipped with a guide bar according to an embodiment of the invention.
Figure 8:
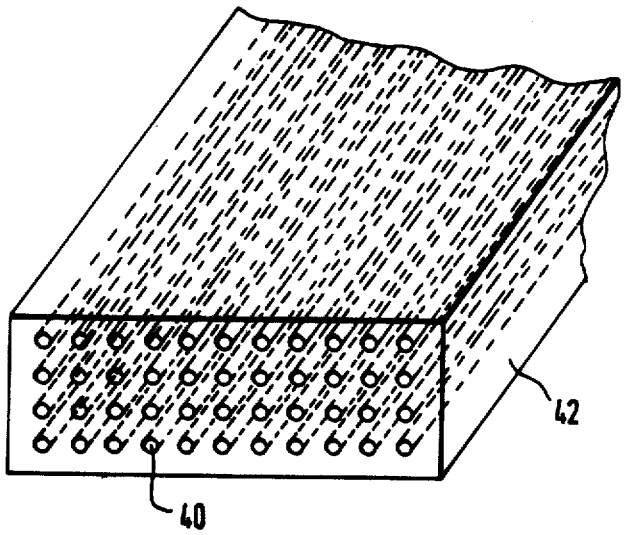
FIG. 8 is a perspective view of the material suitable for use as an insert.

The portable motor-driven chain saw shown in the drawing is identified by reference numeral 1 and includes a housing 2 containing a drive motor 3 which can be configured as a two-cycle internal combustion engine. The housing has a rearward handle 4 in which the throttle lever 5 and throttle lever lock 6 are located. A bale type handle 7 extends over the top of the housing and a guard lever 8 is disposed forward of the handle 7. Furthermore, the motor-driven chain saw 1 has a forwardly extending guide bar 9 which is releasably attached to the forward part of housing 2. A continuous saw chain 10 is guided for movement around the guide bar and is driven by the drive motor 4 in the direction of the arrow shown in FIG. 1.

The guide bar 9 has an elongated slot 12 disposed at the rearward end 11 thereof for attaching the guide bar to the housing 2. Two attachment holes 13 are also provided at the rearward end 11. Turn-around means 15 are provided at the forward free end 14 of the guide bar and can be in the form of a nose sprocket 16. The saw chain 10 is guided on the guide bar 9 in a groove 17 and has drive links which engage the gullets 18 of the nose sprocket 16.

FIGS. 2 to 5 show that the guide bar 9 has two parallel steel plates (19, 20) which are preferably made of a wear resistant heat-treated steel. Each of the steel plates (19, 20) has a cutout 21 disposed between the rearward elongated slot 12 and the forward turn-around means 15 which is configured as an oval extending in the longitudinal direction of the guide bar. The cutout 21 should be provided without a cross member or the like and be uninterrupted throughout for reasons which contribute to the bending strength of the guide bar. In this way, the weight of the steel plates (19, 20) is relatively low. The length of the cutout 21 can be greater by a multiple than the width of the cutout extending in the plane of the height of the plate between the upper and lower saw chain guide grooves 17.

A spacer plate 22 is provided between the two outer steel plates (19, 20) which has approximately the same form as the steel plates (19, 20) and likewise has an elongated slot 12 and two attachment holes 13 in the rearward portion thereof. The height of the spacer plate 22 is however somewhat less than the height of the steel plates (19, 20) so that the guide groove 17 (FIG. 5) is formed between the two steel plates (19, 20) for the saw chain 10 at the top and bottom of the guide bar. In addition, the forward portion of the spacer plate 22 is configured to be shorter than for the steel plates (19, 20) so that a corresponding free space is provided between the steel plates (19, 20) for the nose sprocket 16.

On the mutual opposite sides of the spacer plate 22, are located respective bonded fiber inserts 23 having such a spatial form that they completely fill out the cutouts 21 in respective ones of the steel plates (19, 20) so that there is virtually no gap and the outer surfaces of the bonded fiber insert 23 and the steel plates (19, 20) are precisely planar.

FIG. 4 shows that the thickness of the bonded fiber insert 23 corresponds approximately to the thickness of the steel plates (19, 20). The spacer plate 22 defining the center plane can have approximately the same thickness or be somewhat thicker than one of the steel plates (19, 20).

The bonded fiber insert 23 comprises a plastic which is reinforced with long fibers. The long fibers extend over the entire length of the insert and effect a high strength already with a long fiber volume portion of approximately 30%. An especially high strength of the bonded fiber insert 23 is achieved when the long fiber volume portion amounts to approximately 60%. A further increase in strength can be achieved by aligning the long fibers of the insert 23 in the longitudinal direction of the guide bar 9 so that they lie substantially parallel to one another, that is, so that they are aligned to be unidirectional. The bonded fiber material of the insert 23 can be produced from an unsaturated polyester resin (UP-resin), epoxy resin or polyamide resin. As a reenforcing long fiber, polyester fibers, glass fibers, aramide fibers or carbon fibers can be bound into the above-mentioned resins as a reinforcement. Preferably, the bonded fiber insert 23 is made of an epoxy resin with approximately 70 to 75% carbon fiber or glass fiber reinforcement.

For obtaining an especially high self-rigidity of the guide bar 9, a preferred embodiment provides that the spacer plate 22 and the two side bonded fiber inserts 23 are monolithically configured from the same material. In an embodiment of this kind, the distance plate 22 and the inserts 23 conjointly define one component with the region corresponding to the plate 22 being made of a glass fiber bonded material and the side regions 23 being made of a carbon fiber bonded material and both regions contain long fibers (glass fibers or carbon fibers) having a volume portion of at least approximately 30% and preferably 60% embedded in plastic. With this one piece embodiment, the spacer plate 22 and the fiber bonded inserts 23 can be produced with a single tool in one work step. The plates (22, 23) then have an especially low weight with a very high strength and especially a very high bending rigidity.

However, it can also be advantageous to produce the spacer plate 22 and the two bonded fiber inserts 23 individually. The spacer plate 22 can then be made of another material which is less expensive than the material of the bonded fiber insert 23. Such a less expensive material can be a plastic or a less expensive bonded fiber material. In this connection, it is also possible to produce the outer strips of a plastic of a cheaper kind which extend outwardly beyond the spacer plate 22 since these outer strips have essentially only the function of providing a spacing for the outer steel plates (19, 20). The bonded fiber insert 23 and the spacer plate 22 can be glued to each other. An adhesive based on epoxy resin is preferably used as an adhesive. There is also the possibility to join the spacer plate 22 and the lateral bonded fiber inserts 23 by means of rivets or threaded fasteners.

A stable bond of the multi-layered guide bar 9 can advantageously be achieved in that the bonded fiber inserts 23 be glued together with the inner surfaces of the steel plates (19, 20) by means of an adhesive having an epoxy resin base or the like. The inserts 23 are glued to the inner surfaces of the steel plates (19, 20) in the cutouts 21 thereof.

In the preferred embodiment shown in FIGS. 2 to 5, the outer steel plates (19, 20) can be connected with each other at several locations by means of welding. For the connection, form parts 24 which can be electrowelded and which are preferably made of steel, can be mounted between the two steel plates (19, 20). The thickness of the form parts 24 is approximately the same as the thickness of the distance plate 22 or the width of the groove 17. The form parts 24 can be arranged in series one behind the other at approximately the same spacing and engage in round recesses 25 which are provided in the peripheral region of the spacer plate 22 outside of the periphery of the bonded fiber insert 23 or even in the insert 23. The form parts 24 can engage the cutouts 25 of the spacer plate 22 without play by means of appropriate projections. The form parts 24 have the function to produce the electrical connection between the outer steel plates (19, 20) so that a trouble-free electric welding of the plates (19, 20) can be achieved.

The nose sprocket 16 can be journalled on a shaft disc 26 which is substantially as thick as the form parts 24 and the spacer plate 22. The shaft disc 26 determines the spacing at the forward bar end 14 between the two steel plates (19, 20). The nose sprocket 16 is somewhat thinner than the shaft disc 26 so that it can rotate freely and unimpeded between the steel plates (19, 20). The steel plates (19, 20) and the shaft disc 26 can be connected to define one component by rivets 27 or by electric spot welding so that also here at the forward bar end 14, a high strength is provided at the end 14 where the guide bar is highly loaded especially during chain saw plunge-cutting operations.

In the embodiments shown in FIGS. 6 and 7, the guide bar 9*a* is configured as a so-called full bar, that is, a guide bar which does not comprise several layered plates and instead comprises a single steel plate 28. No nose sprocket is provided for the saw chain turn-around 15 at the forward end 14 of the guide bar; instead, the groove 17 is extended around the half-circle shaped guide bar end 14. At the rearward guide bar end 11, an elongated slot 12 and two attachment holes 13 are likewise provided in the full bar 28 for positioning the guide bar to the housing 2 of the motor-driven chain saw 1. A cutout 29 can be provided in the full bar 28 which extends through the entire thickness of the bar and which is configured substantially in the same manner as the cutout 21 of the embodiment described above. The bonded fiber insert 30 is disposed in the cutout 29 of the full bar 28 and is made of plastic and preferably epoxy resin. The bonded fiber insert 30 comprises a reinforcement which is formed by long fibers which are preferably carbon fibers and/or glass fibers having a proportionate volume of the insert amounting to at least approximately 30% and preferably approximately 50 to 75%. In a preferred embodiment, the long fibers constitute a volume portion of 60% of the insert. The bonded fiber material can be the same as the material of the bonded fiber insert 23 of the embodiment described above.

The bonded fiber insert 30 is mounted so as to fit in the cutout 29. Projections 31 and spaces 32 formed at the edge of the cutout 29 interdigitally engage projections 31 and slots 32 formed in the edge region of the bonded fiber insert 30. An especially tight intermeshing can be achieved when the projections 31 and the cutouts 32 are configured to have an undercut 33. In this way, the projections 31 and the cutouts 32 are configured to have a trapezoidal or dove-tail configuration. Furthermore, it is advantageous for the strength of the guide bar 9*a* to tightly connect the bonded fiber insert 30 and he steel plate 28 at the edge of the cutout 29, that is, in the region of the projections 31 and cutouts 32. The adhesive is preferably an adhesive having an epoxy resin base. The precise-fit connection can also be achieved by configuring the cutout 29 in the full bar 28 to have a step-like shape in which the reinforced bonded fiber insert 30 can then be seated. The connection between the inner wall of the cutout 29 and the relatively light plastic part 30 can also be reinforced by gluing.

As shown in FIG. 7*a*, the bar 28*a* and insert 30*a* cut out 29*a* can be joined together exclusively or additionally in the manner of a tongue-in-groove connection which is provided in the plane of the groove 17.

A substantial advantage of the invention is that the cutouts in the steel plates (19, 20, 28) are configured to be as large as possible and can be substantially freely formed as to their geometric shape. The cutouts (21, 29) are filled with a plastic whose strength is extremely increased by embedding long fibers therein. Such a bonded fiber material can take up high pressure and tension forces as well as torsion and bending loads so that the guide bar 9*a* is provided with an increase in stability and strength as a consequence of optimally configured cutouts (21, 29) in the guide bar steel plates (19, 20, 28) with the latter having a minimal weight and just so much that an adequate amount for wear is provided.

Figure 9:
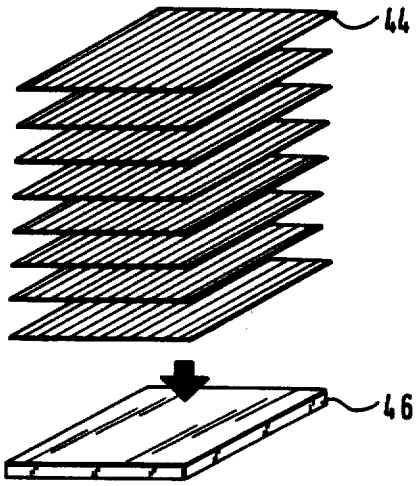
FIG. 9 is an exploded view of a unidirectional laminate showing the making up the latter.
Figure 10:
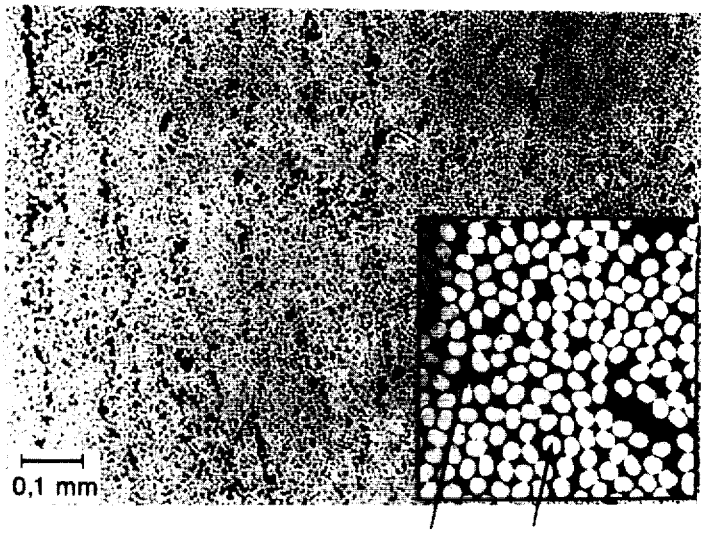
FIG. 10 is a cross section taken through a portion of an insert of epoxy resin and strengthened by means of unidirectional carbon fibers; and, FIG. 11 is an exploded view of a multi-directional laminate showing the various,layers making up the latter.

The bonded fiber insert utilized in the embodiments discussed above can be a matrix 42 having unidirectional fibers 40. The insert can be in the form of a laminate as shown in FIG. 9 where the laminations 44 are stacked to form the unidirectional layer 46. FIG. 10 shows a cross section taken through a unidirectional layer of epoxy resin reinforced with carbon fibers. The lower right-hand portion is enlarged to show the matrix 42 and the carbon fibers which can each have a diameter of 7 $\mu$m.

Figure 11:
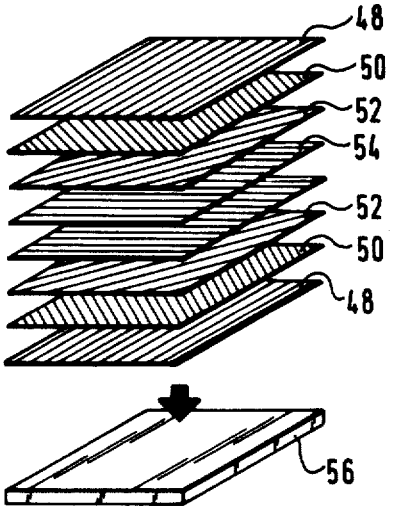

FIG. 11 shows another embodiment of a laminate 56 which is made up of laminations (48, 50, 52 and 54). Laminate 56 is a multi-directional laminate with the fibers having the orientation shown in FIG. 11. The laminate can also be configured of layers having fibers which are disposed at 90° with respect to each other. Thus, a suitable laminate 56 could comprise only the layers exemplified by layers 48 and 54.

It is understood that the foregoing description is that of the preferred embodiments of the invention and that various changes and modifications may be made thereto without departing from the spirit and scope of the invention as defined in the appended claims.

What is claimed is:

1. A guide bar for guiding the saw chain of a chain saw comprising:

an elongated steel plate defining a longitudinal bar axis and having a first longitudinal end adapted for attachment to the chain saw and a second longitudinal end;

said steel plate having a peripheral edge defining a guide groove for guiding the said chain in its movement around the guide bar;

turn around means at said second longitudinal end for guiding the saw chain around said second longitudinal end;

said plate defining an elongated clear and uninterrupted cutout formed therein so as to have a longitudinal cutout axis extending substantially in the same direction as said longitudinal bar axis;

said cutout having a width measured transversely to said cutout axis and a length measured along said cutout axis; said length being a multiple of said width; and, a plastic insert filling out said cutout and being reinforced with long fibers to form a bonded fiber material with most of said fibers extending substantially parallel to said axes thereby making said insert and said guide bar resistant to bending and torsion forces as well as to compression and tension forces.

2. The guide bar of claim 1, said long fibers constituting a volume percent of said insert of approximately 30 to 80%.

3. The guide bar of claim 1, said long fibers constituting a volume percent of said insert of approximately 60%.

4. The guide bar of claim 1, said guide bar defining a longitudinal axis and said long fibers being aligned so as to be unidirectional in the direction of said axis.

5. The guide bar of claim 1, said insert including a matrix portion in the form of a resin system with said long fibers defining a fiber portion of said insert bound into said resin system.

6. The guide bar of claim 1, said insert including a matrix portion in the form of thermoplastic and said long fibers defining a fiber portion of said insert bound into said thermoplastic.

7. The guide bar of claim 1, said insert including a matrix portion in the form of an epoxy resin with said long fibers defining a fiber portion of said insert and said long fibers being carbon fibers.

8. The guide bar of claim 1, said insert including a matrix portion in the form of an epoxy resin with said long fibers defining a fiber portion of said insert and said long fibers being glass fibers.

9. The guide bar of claim 1, said insert including a matrix portion in the form of an epoxy resin with said long fibers defining a fiber portion of said insert and said long fibers including carbon fibers and glass fibers.

10. The guide bar of claim 1, said guide bar defining a longitudinal axis and having a rearward end portion and a forward end portion; said guide bar including: attachment means formed in said rearward end portion for attaching the guide bar to the chain saw; turn-around means in said forward end portion for guiding the saw chain around said forward end portion; and, said guide groove including an upper groove segment and a lower groove segment; said cutout being formed in said plate so as to extend in the direction of said axis between said forward and rearward end portions and to have a length greater in the direction of said axis than in the direction perpendicular to said axis between said upper and lower groove segments.

11. The guide bar of claim 10, said cutout being elongated and being rounded at longitudinally opposite ends thereof; and, said insert being likewise elongated and rounded at its longitudinal ends.

12. The guide bar of claim 1, said plate having an inner edge defining the periphery of said cutout and said insert having a peripheral edge defining an engagement interface with said inner edge; and, interface holding means disposed at said interface for holding said insert in said plate in a form-tight manner.

13. The guide bar of claim 12, said interface holding means comprising a first castellation formed on said inner edge; and, a second castellation formed on said peripheral edge so as to be in interdigitating engagement with said first castellation.

14. The guide bar of claim 13, said first and second castellations being undercut to conjointly define a dovetail connection.

15. The guide bar of claim 12, said holding means being a tongue-in-groove joint formed at said interface of said inner and peripheral edges.

16. The guide bar of claim 12, said interface holding means being an adhesive placed at said interface of said inner edge and said peripheral edge.

17. A guide bar for guiding the saw chain of a chain saw, the guide bar comprising:

two mutually parallel elongated steel plates conjointly defining a space therebetween and having respective cutouts formed therein;

a spacer member having two flat sides and being sandwiched between said steel plates;

said plates and said spacer conjointly defining the guide bar to have a peripheral guide groove for guiding the saw chain in its movement around the guide bar;

said bar defining a longitudinal bar axis and having a first longitudinal end adapted for attachment to the chain saw and a second longitudinal end;

turn around means at said second longitudinal end for guiding the saw chain around said second longitudinal end;

each of said cutouts being clear and uninterrupted and formed in the plate corresponding thereto so as to have a longitudinal cutout axis extending substantially in the same direction as said bar axis;

each of said cutouts having a width measured transversely to said cutout axis and a length measured along said cutout axis; said length being a multiple of said width;

said spacer member having inserts on respective ones of said flat sides for engaging corresponding ones of said cutouts; and, said spacer being made of plastic reinforced with long fibers to form a bonded fiber material with most of said fibers extending substantially parallel to said axes thereby making said spacer and said guide bar resistant to bending and torsion forces as well as to compression and tension forces.

18. The guide bar of claim 17, each of said inserts having a thickness approximately the same as the thickness of the plate corresponding thereto.

19. The guide bar of claim 18, said spacer member and said inserts being joined to said plates with adhesive means so as to define a single component.

20. The guide bar of claim 19, said adhesive means being an adhesive having an epoxy resin base.

21. The guide bar of claim 17, comprising a plurality of form parts mounted in said spacer member and each of said form parts defining a weld connection between said steel plates.

22. The guide bar of claim 21, said spacer member having a plurality of openings formed therein and said metal form parts having extensions which penetrate said openings.

23. The guide bar of claim 22, said openings being arranged in a row one behind the other and outside of said inserts.

24. The guide bar of claim 17, said inserts being attached to said flat sides, respectively, by gluing.

25. The guide bar of claim 17, said spacer member being made of a first material and said inserts being made of a second material in the form of a bonded fiber material; said first material having a lesser value than said second material and said first material being a low-cost material selected from the group consisting of plastic and lowcost bonded fiber material.

26. The guide bar of claim 17, said spacer member and said inserts conjointly defining a monolithic component.

27. The guide bar of claim 26, said spacer member having glass fibers embedded therein and said inserts each having carbon fibers embedded therein.

28. The guide bar of claim 1, said fibers extending over substantially the entire length of said insert.

29. The guide bar of claim 1, said elongated steel plate being a single plate made of solid material; and, said cutout being a single elongated cutout extending substantially from said first longitudinal end to said second longitudinal end.

30. The guide bar of claim 29, said long fibers constituting a volume percent of said insert of approximately 30 to 80%.

31. The guide bar of claim 12, said elongated steel plate being a single plate made of solid material; and, said cutout being a single elongated cutout extending substantially from said first longitudinal end to said second longitudinal end.

32. The guide bar of claim 17, said fibers extending over substantially the entire length of said spacer.

33. The guide bar of claim 17, each of said cutouts being a single elongated cutout extending substantially from said first longitudinal end to said second longitudinal end.

34. The guide bar of claim 33, said long fibers constituting a volume percent of said spacer of approximately 30 to 80%.

* * * * *

UNITED STATES PATENT AND TRADEMARK OFFICE

CERTIFICATE OF CORRECTION

PATENT NO. : 4,903,410

DATED : February 27, 1990

INVENTOR(S) : Klaus Wieninger, Walter Sattelmaier, Wilfried Noll, Hans Peter Stehle and Norbert Apfel It is certified that error appears in the above-identified patent and that said Letters Patent is hereby corrected as shown below:

In column 2, line 12: insert -- side -- between "a" and "elevation".

In column 2, line 18: insert -- with -- between "shown" and "one".

In column 2, line 30: insert -- layers -- between "the", first occurrence, and "making".

In column 2, line 32: insert -- made -- between "insert" and "of", first occurrence.

In column 2, line 35: delete the comma after "various".

In column 5, line 29: delete "he" and substitute -- the -- therefor.

In column 5, line 39: insert -- in -- between "insert 30a" and "cut".

In column 6, line 20: delete "said" and substitute -- saw -- therefor.

Signed and Sealed this

Twenty-fifth Day of June, 1991

*Attest:*

*Attesting Officer*

HARRY F. MANBECK, JR.

*Commissioner of Patents and Trademarks*